US009693590B2

(12) United States Patent
Hendrickson

(10) Patent No.: US 9,693,590 B2
(45) Date of Patent: Jul. 4, 2017

(54) SHAPING GARMENT

(71) Applicant: Destination Maternity Corporation, Philadelphia, PA (US)

(72) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 288 days.

(21) Appl. No.: 14/332,677

(22) Filed: Jul. 16, 2014

(65) Prior Publication Data

US 2016/0015087 A1 Jan. 21, 2016

(51) Int. Cl.

| | |
|---|---|
| ***A41C 1/02*** | (2006.01) |
| ***A41C 1/00*** | (2006.01) |
| ***A41C 5/00*** | (2006.01) |
| ***A41C 1/08*** | (2006.01) |
| ***A41D 1/20*** | (2006.01) |

(52) U.S. Cl.

CPC ..... *A41C 1/02* (2013.01); *A41C 1/003* (2013.01); *A41C 1/08* (2013.01); *A41C 5/00* (2013.01); *A41D 1/20* (2013.01); *A41D 2400/38* (2013.01)

(58) Field of Classification Search

CPC ..... A41B 9/001; A41B 9/00; A41B 11/14; D04B 1/108; A41C 1/02; A41C 1/08

USPC ..... 450/94–117; 66/171, 175, 176, 177; 2/409, 403, 400, 401

See application file for complete search history.

(56) References Cited

U.S. PATENT DOCUMENTS

| | | | | |
|---|---|---|---|---|
| 3,425,246 | A * | 2/1969 | Knohl | D04B 1/108 66/171 |
| 5,572,888 | A * | 11/1996 | Browder, Jr. | D04B 1/243 2/401 |
| 5,787,512 | A * | 8/1998 | Knox | A41B 11/14 2/409 |
| 6,276,175 | B1 * | 8/2001 | Browder, Jr. | A41B 9/001 2/409 |
| 7,048,013 | B2 | 5/2006 | Shannon | |
| 7,159,621 | B2 | 1/2007 | Shannon | |
| 2009/0068908 | A1 | 3/2009 | Hinchcliff | |
| 2011/0003533 | A1 | 1/2011 | Caruso et al. | |
| 2012/0060253 | A1 | 3/2012 | Bergin et al. | |
| 2012/0144548 | A1 | 6/2012 | Quaranta | |

* cited by examiner

*Primary Examiner* — Gloria Hale
(74) *Attorney, Agent, or Firm* — DLA Piper LLP (US)

(57) ABSTRACT

Garments that can be worn during early stages of pregnancy and postpartum are disclosed. The garments shape or contour the stomach or abdomen regions of the wearer to give the abdomen a smoother and slimmer appearance. The garments comprise at least one shaper stitch region that is adapted to apply a compressive force to the wearer's abdomen to shape the stomach or abdomen regions of the wearer.

33 Claims, 7 Drawing Sheets

SHAPING GARMENT

TECHNICAL FIELD

This disclosure relates to a shaping garment that may be worn during early stages of pregnancy, postpartum and other times to shape and contour a wearer's body.

BACKGROUND

Shaping garments intended to support and shape a wearer's abdomen or belly region have been manufactured from knits or woven fabrics. Some of the knits or woven fabric garments are constructed with an elastic belt or waist band which causes discomfort when tightened about the body. Some of the garments have stretchable fabric panels sewn into place with seams which cause discomfort when elastic stretching of the panels presses the seams against the wearer's torso. Moreover, women have complained that such garments are difficult to keep in place, as they gradually slip downward while they are being worn.

Accordingly, a need exists for a garment that supports and shapes the abdomen during early stages of pregnancy and postpartum. More particularly, a need exists for a garment that shapes the contours of the abdomen to give the body a smoother and slimmer appearance and desirably would fit comfortably while being worn.

SUMMARY

The present disclosure provides a garment that includes an upper garment portion configured to encircle a wearer's torso with an uppermost edge portion configured to reside in proximity to the wearer's inframammary line. The upper garment portion may be seamlessly connected to a lower garment portion comprising leg portions. The garment may include at least one shaper stitch region comprising a circumferential portion that extends circumferentially around the upper garment portion and downwards from the uppermost edge portion and a pelvis covering portion that extends towards a frontal crotch area of the garment. The shaper stitch region may be adapted to apply a compressive force to the wearer's abdomen when the garment is worn by the wearer.

The present disclosure further provides alternative examples of garments that may include a seamless upper garment portion and a lower garment portion connected to a lower edge of the upper garment portion, wherein an upper perimeter of the lower garment portion recedes downward in a parabolic curve. The garments may also include at least one shaper stitch region on the upper garment portion adapted to apply a compressive force to the wearer's abdomen when worn by the wearer.

Still further, the present disclosure provides a method of manufacturing a support garment comprising knitting a garment material and applying a shaper stitch region to a portion of the garment material, said knitting material having an elevated modulus of elasticity.

DETAILED DESCRIPTION

Figure 1:
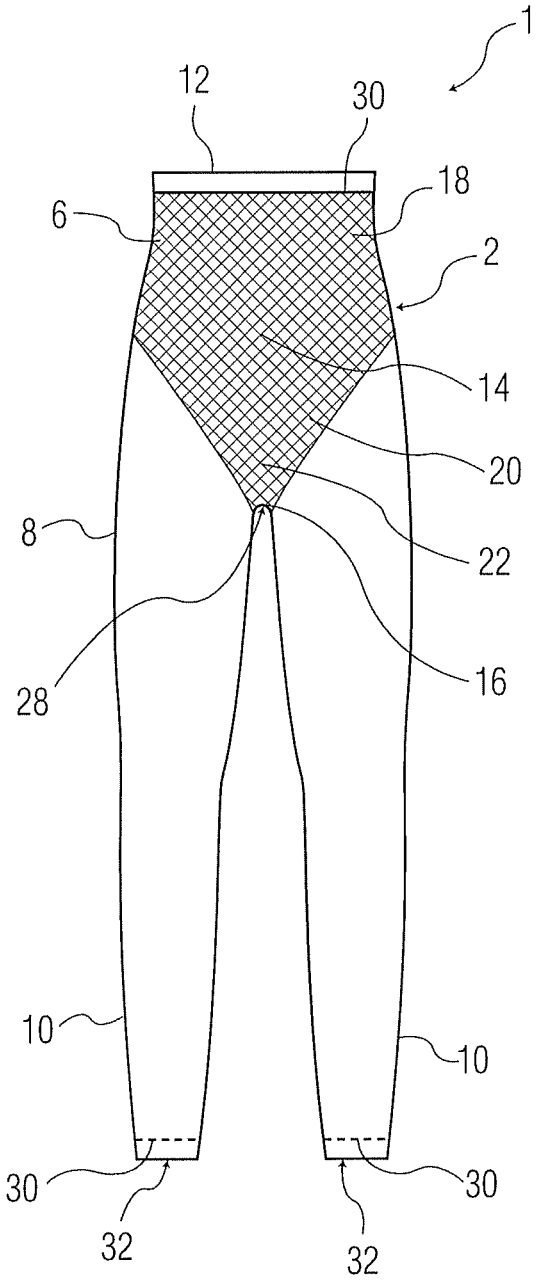
FIG. 1 is a front view of an exemplary garment.

It will be appreciated that the following description is intended to refer to specific examples of structure selected for illustration in the drawings and is not intended to define or limit the disclosure, other than in the appended claims.

Garments of this disclosure can be worn during early stages of pregnancy and postpartum and are comfortable for the wearer. The garments are suitable for shaping or contouring the stomach or abdomen region of the wearer to give the abdomen a smoother and slimmer appearance. To contour or shape the abdomen, the garments of this disclosure may apply a compressive force on the wearer's abdomen, particularly in regions desiring shaping or contouring.

Figure 2:
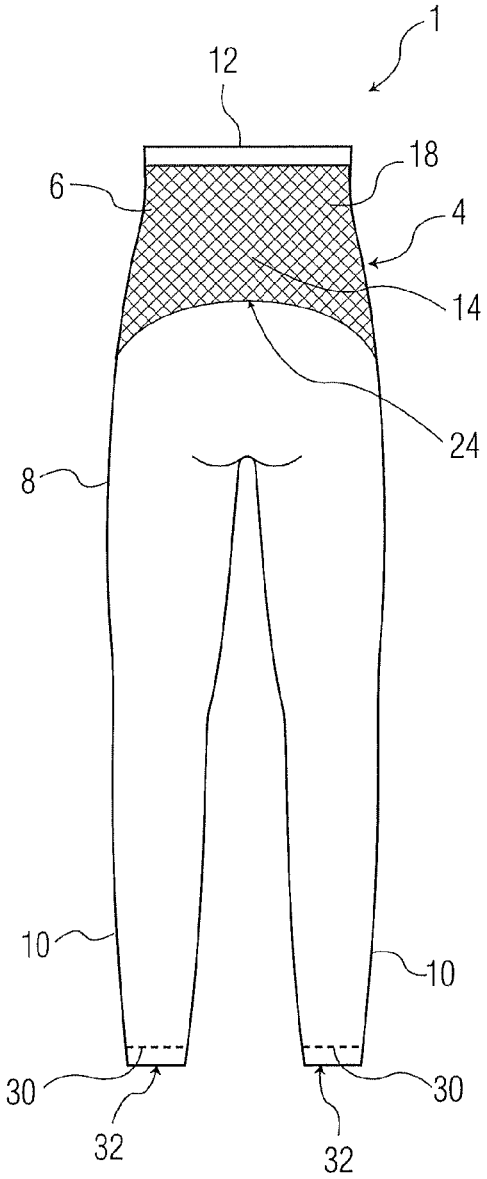
FIG. 2 is a rear view of the exemplary garment depicted in FIG. 1.
Figure 3:
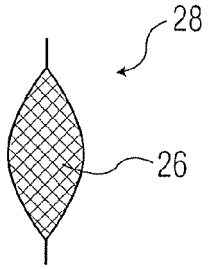
FIG. 3 is a bottom view of a crotch area of the exemplary garment depicted in FIG. 1.

Turning now to the figures, an exemplary shaping garment 1 is depicted by various views in FIGS. 1 to 3. As shown in FIGS. 1 and 2, the garment 1 has a front side 2 and back side 4 and comprises an upper garment portion 6 connected to a lower garment portion 8.

The upper garment portion 6 may generally be tubular and configured to encircle a wearer's torso. As shown in FIG. 1, the upper garment portion 6 of the front side 2 is configured to extend from a position along the left lateral side of the wearer's abdomen across a front side of the wearer's abdomen to a position along the right lateral side of the wearer's abdomen. Likewise, as shown in FIG. 2, the upper garment portion 6 of the back side 4 is configured to extend from a position along the left lateral side of the wearer's abdomen across a back side of the wearer's abdomen to a position along the right lateral side of the wearer's abdomen. Optionally, the upper garment portion 6 may be seamless along the right and left lateral sides of the front side 2 and rear side 4.

In an exemplary embodiment, the upper garment portion 6 may be configured to extend over a substantial portion of the wearer's abdomen such that an uppermost edge portion 12 of the upper garment portion 6 on the front side 2 of the garment 1 may reside in proximity to a wearer's inframammary line when the garment 1 is worn by the wearer. The uppermost edge portion 12 of the upper garment portion 6 on the back side 4 of the garment 1 may reside along a substantially parallel line at a position along the back side of the wearer's torso.

As referred to herein, "in proximity to the wearer's inframammary line" generally refers to an anatomical region at or near the inframammary line of the wearer. An inframammary line is a natural boundary below a wearer's breasts where the underside of the wearer's breasts and the chest wall meet. A region in proximity to the wearer's inframammary line may be above a midline between an inframammary line and a transpyloric plane of the wearer when the garment is worn.

For contouring or shaping the abdomen, the garment 1 of FIGS. 1 and 2 comprises at least one shaper stitch region 14. As used herein, "shaper stitch region" refers to a region of a garment or garment material having a modulus of elasticity in at least one direction such that an elastic resistance of the material is configured to apply a compressive force to at least a portion of the wearer's body when a fitted garment is worn by a wearer. For example, the modulus of elasticity of garment material in a horizontal direction may be greater in a shaper stitch region 14 such that a greater amount of force is required to stretch the material to a certain length in a horizontal direction than is required to stretch material in another region of the garment or garment material to which shaper stitching has not been applied to the same length.

Optionally, the modulus of elasticity of the material composing the shaper stitch region 14 may be substantially uniform, although different areas of the shaper stitch region 14 may exhibit different moduli of elasticity. As a result, the shaper stitch region 14 may be adapted to apply a uniform compressive force to the wearer's entire abdomen or different compression to various areas of the wearer's abdomen when the garment 1 is worn. Moreover, a garment may have multiple shaper stitch regions 14, each having similar or varying moduli of elasticity such that the garment comprises a plurality of portions configured to apply targeted compressive forces to the wearer's abdomen when the garment is worn.

In contrast to the shaper stitch region 14, one or more regions of the garment 1 or garment material to which shaper stitching has not been applied may be expansible to accommodate portions the wearer's body. As a result, those area(s) that do not include shaper stitching may not apply a substantial compressive force to shape the wearer's body. Shaper stitch regions 14 and regions of the garment or garment material to which shaper stitching has not been applied may be seamlessly connected and may or may not be visually distinguishable. Further, the entire garment 1 may be formed of a single piece of material to which shaper stitching is applied.

One or more shaper stitch regions 14 may be disposed in selectively located regions of garment 1 such that, when the garment 1 is worn, the shaper stitch regions 14 are adapted to cover and apply a compressive force to selected areas of the wearer's body to provide shaping or contouring. FIGS. 1 and 2 and illustrate an exemplary arrangement of a shaper stitch region 14 on the garment 1 for shaping or contouring areas of the wearer's abdomen.

As seen in FIG. 1, at least a portion of a shaper stitch region 14 is disposed on the front side 2 of the upper garment portion 6. As shown, at least a portion of the shaper stitch region 14 may be configured to extend from a position along the left lateral side of the wearer's abdomen across a front side of the wearer's abdomen to a position along the right lateral side of the wearer's abdomen. Additionally, as seen in FIG. 2, at least a portion of the shaper stitch region 14 may be configured to extend from a position along the left lateral side of the wearer's abdomen across a back side of the wearer's abdomen to a position along the right lateral side of the wearer's abdomen.

As best seen by comparison of FIGS. 1 and 2, which respectively show views the front side 2 and back side 4 of the garment 1, a portion of the shaper stitch region 14 extending across the front side of the wearer's abdomen on the front side 2 and a portion of the shaper stitch region 14 extending across the back side of the wearer's abdomen on the back side 4 of the garment 1 may be continuous so as to form at least one circumferential portion 18 extending circumferentially around the upper garment portion 6. The circumferential portion 18 of shaper stitch region 14 may circumferentially apply a compressive force 360° around the wearer's abdomen to provide 360° of contouring and shaping. This circumferential portion 18 may abut and extend downwards from the uppermost edge portion 12.

Additionally, as shown in FIG. 1, the front side 2 of the garment may further include a non-circumferential portion 20 of the shaper stitch region 14 that extends less than 360° around the wearer. As shown in FIG. 1, the non-circumferential portion 20 of the shaper stitch region 14 on the front side 2 of the garment 1 extends downward from the circumferential portion 18 of the shaper stitch region 14 towards a frontal crotch area 16 of the garment 1. The non-circumferential portion 20 of the shaper stitch region 14 shown in FIG. 1 may be adapted to reside over the region proximal to a wearer's frontal pelvic area (or lower abdomen) when the garment is worn such that it forms a pelvis covering portion 22 of the shaper stitch region 14. As shown, the pelvis covering portion 22 of the shaper stitch region 14 is configured to extend over the wearer's frontal pelvic area between lines where the wearer's legs meet the pelvis (i.e., between groin lines) and downwards to the frontal crotch area 16 of the garment 1. Accordingly, a width of the pelvis covering portion 22 of the shaper stitch region 14 may optionally narrow as it extends downwards and approaches the frontal crotch portion 16 of the garment so that the pelvis covering portion 22 may have a shape similar to an inverted triangle.

Referring again to FIG. 2, a shaper stitch region 14 on the back side 4 of the garment 1 may abut the uppermost edge portion 12 and extend downward to an area at or near an upper perimeter of the wearer's buttocks 24 region when the garment is worn. Notably, it is not necessary for the shaper region 14 to cover the wearer's buttocks or cover the wearer's legs. However, if desired, one or more shaper stitch regions 14 may extend over or be applied to portions of the garment that cover the wearer' buttocks and/or legs. If included, such shaper stitch regions 14 may be separate from or continuous with a shaper stitch region 14 extending over the upper garment portion 6 of the garment 1.

While not shown in FIGS. 1 and 2, it should be appreciated that either or both of the front side 2 or back side 4 of the garment 1 may comprise one or more additional non-circumferential portions 20 of the shaper stitch region 14 which may be separate from or continuous with the circumferential portion 18 of the shaper stitch region 14.

Still referring to FIGS. 1 and 2, the lower garment portion 8 is shown in connection with the upper garment portion 6. As noted above, the garment 1 may comprise a single piece of fabric or it may be formed of multiple fabric pieces. The lower garment portion 8 may comprise at least one, and in this example, two leg portions 10 each configured to encircle and cover at least a portion of one of a wearer's legs. The length of the leg portions 10 may be configured as desired to provide various leg coverage. For example, the leg portions 10 may be generally tubular and configured such that the lowermost edges 32 of the leg portions 10 extend to an area above, at or below the wearer's knees when the garment is worn, including to any point between the wearer's knees and ankles. As shown in FIGS. 1 and 2, the exemplary garment 1 includes leg portions 10 that extend to substantially cover the wearer's legs down to the wearer's ankles. However, it should be understood that the garment 1 may be configured as any type of garment, such as any style of pants, such as capri-length pants, jeans, trousers, leggings, sweat pants, yoga pants, shorts or the like. Alternatively, the leg portions 10 may include openings adapted to receive the wearer's legs, but lack tubular leg-covering portions such that the garment 1 is configured as underwear, swimwear or similar.

The uppermost edge portion 12 and lowermost edges 32 of the leg portions 10 may comprise hems 30. Hems 30 may be formed by any suitable hemming technique, including but not limited to tubular hem stitching and the like. Aside from the hems 30, the remainder of the garment 1 may comprise a single layer of material.

Turning now to FIG. 3, the crotch area 28 of the garment 1 is shown comprising an optional gusset 26 connected to the lower garment portion 8. The gusset 26 may be formed from material that has a modulus of elasticity higher in a first direction than in a second direction. However, it should be appreciated that suitable garments according to the present disclosure can be formed without gussets if desired.

Figure 4:
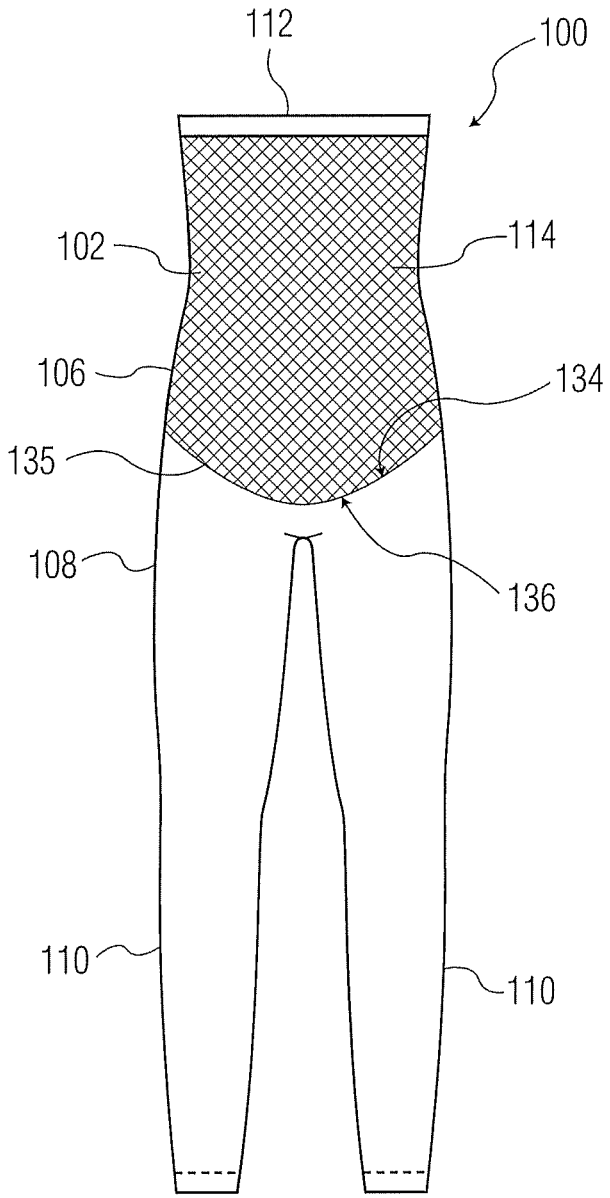
FIG. 4 is a front view of an alternative exemplary garment.
Figure 5:
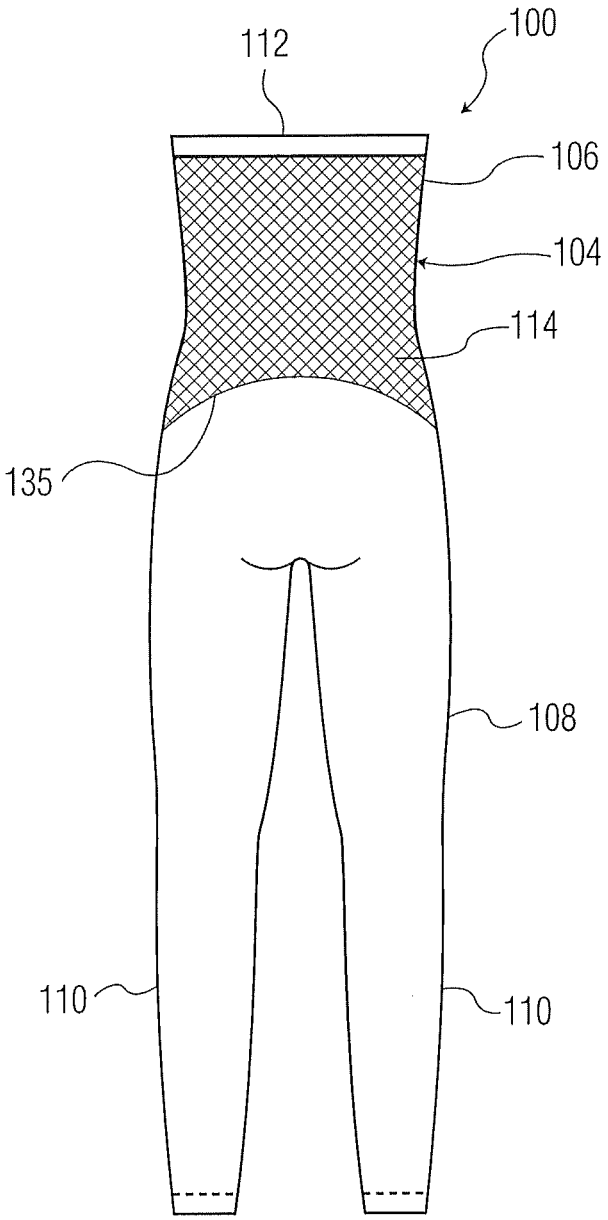
FIG. 5 is a rear view of the alternative exemplary garment depicted in FIG. 4.

Turning now to FIGS. 4 and 5, an alternative example of a shaping garment 100 according to the present disclosure is shown. This exemplary garment 100 has a front side 102 and rear side 104 and comprises an upper garment portion 106 connected to a lower garment portion 108 by a seam 135. The lower garment portion 108 comprises two generally tubular leg portions 110 configured to encircle at least a portion of a wearer's legs. The leg portions 110 may extend to an area above, at or below the wearer's knees.

Similar to the upper garment portion 6 of garment 1 of FIG. 1, the upper garment portion 106 of this exemplary garment 100 may be seamless, generally tubular and configured to encircle a wearer's torso. The upper garment portion 106 may also be configured to extend over a portion of the wearer's abdomen such that an uppermost edge portion 112 of the upper garment portion 106 on a front side 102 of the garment 100 may reside in proximity to a wearer's inframammary line when the garment is worn.

As shown in FIGS. 4 and 5, the lower perimeter 134 of upper garment portion 106 in a front side 102 of the garment 100 projects downward with a somewhat parabolic shape to accommodate bellies of various shapes or sizes. The upper perimeter 136 of the lower garment portion 108 in a front side 102 of the garment 100 may also be configured to recede downwards with a parabolic shape adjacent to and below the lower perimeter 134 of the upper garment portion 106 to make way for bellies of different sizes and shapes. The parabolic shape may include a shallow curvature, or, alternatively, a more pronounced curvature. Still further, the shape of the perimeters 134, 136 may have no curvature, or an inverted curvature.

The upper garment portion 106 may comprise at least one shaper stitch region 114. As shown by example in FIGS. 4 and 5, the shaper stitch region 114 may extend circumferentially around all or portions of the upper garment portion 106.

Figure 6:
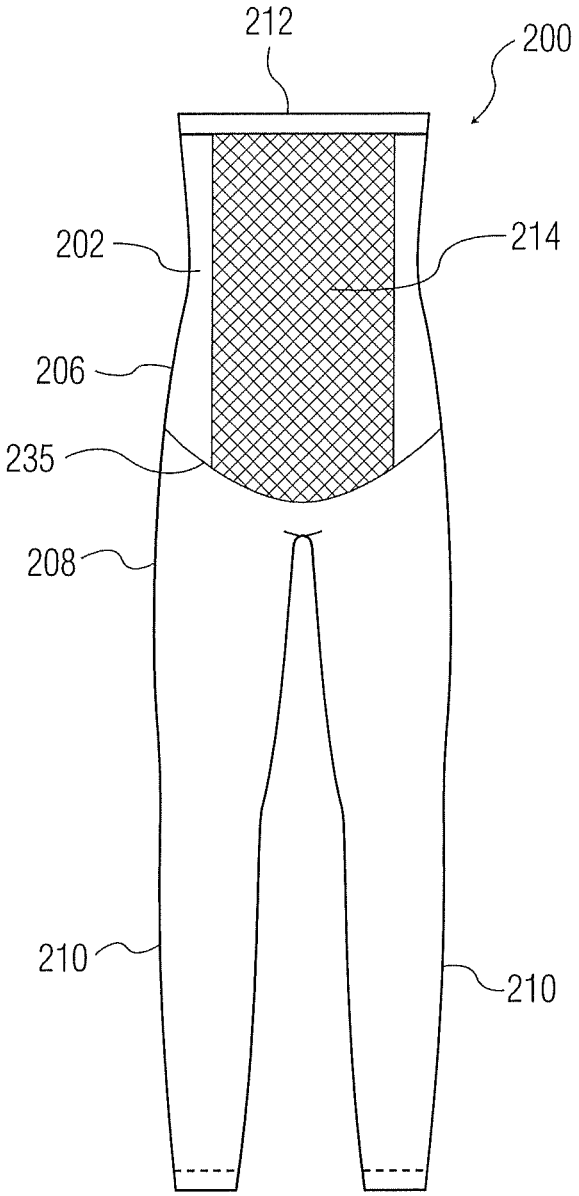
FIG. 6 is a front view of a further alternative exemplary garment.
Figure 7:
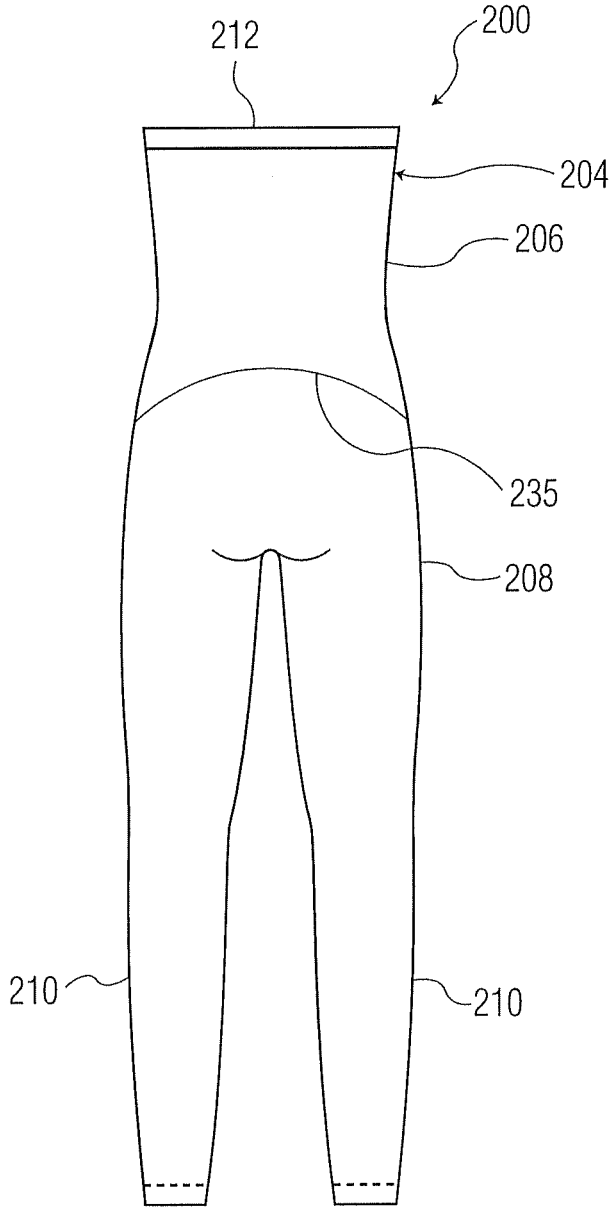
FIG. 7 is a rear view of the further alternative exemplary garment depicted in FIG. 6.

Turning now to FIGS. 6 and 7, a further exemplary garment 200 according to the present disclosure is shown. This exemplary garment 200 includes a shaper stitch region 214 configured differently than the shaper stitch regions 14, 114 discussed above. For example, as shown in FIGS. 6 and 7, an alternative example of a shaping garment 200 may comprises a non-circumferential shaper stitch region 214 extending less than 360° around the upper garment portion 206. As shown in FIG. 6, the shaper stitch region 214 may be localized to the upper garment portion 206 in the front side 202 of the garment 200 and may not extend to the rear side 204 of the garment 200. Optionally, a shaper stitch region 214 having a higher modulus of elasticity may be localized to the upper garment portion 206 in the front side 202 of the garment 200 and a shaper stitch region (not shown) having a lower modulus of elasticity may extend from the shaper stitch region 214 around the rear side 204 of the garment 200 to provide differing degrees of compression and shaping.

Figure 8:
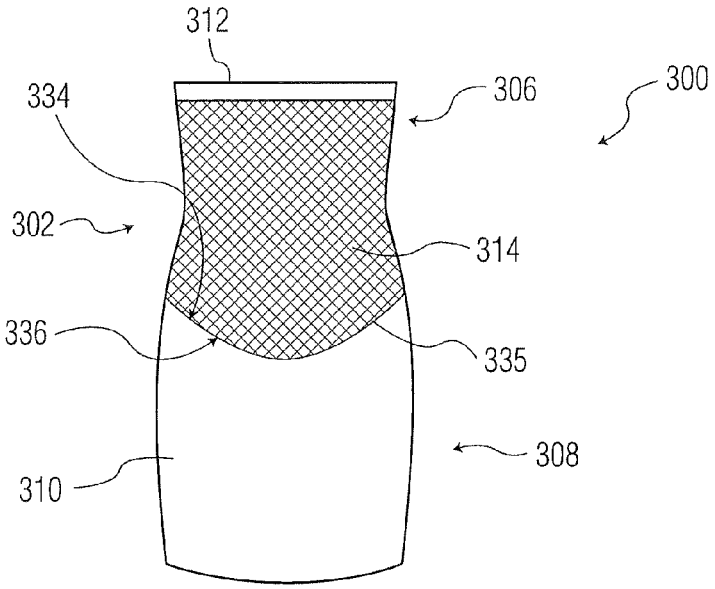
FIG. 8 is a front view of yet another alternative exemplary garment.
Figure 9:
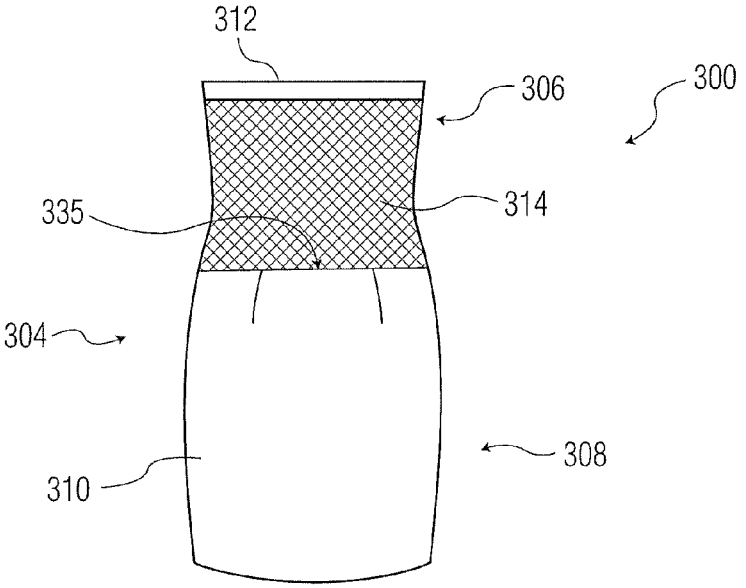
FIG. 9 is a rear view of the alternative exemplary garment depicted in FIG. 8.

FIGS. 8 and 9 depict a further exemplary garment 300 configured as a skirt, which may be of any style, such as any type of long, mid-rise or short skirts, as well as similar type of garments. Like the garment 200 depicted in FIGS. 4 and 5, the garment 300 has a front side 302 and rear side 304 and comprises an upper garment portion 306 connected to a lower garment portion 308 by a seam 335. The lower garment portion 308 comprises a generally tubular leg portion 310 configured to encircle at least a portion of both of a wearer's legs. The leg portion 310 may extend to an area above, at or below the wearer's knees.

Similar to the upper garment portion 6 of garment 1 of FIG. 1, the upper garment portion 306 of this exemplary garment 300 may be seamless, generally tubular and configured to encircle a wearer's torso. The upper garment portion 306 may also be configured to extend over a portion of the wearer's abdomen such that an uppermost edge portion 312 of the upper garment portion 306 on a front side 302 of the garment 300 may reside in proximity to a wearer's inframammary line when the garment is worn.

As shown in FIGS. 8 and 9, the lower perimeter 334 of upper garment portion 306 in a front side 302 of the garment 300 projects downward with a somewhat parabolic shape to accommodate bellies of various shapes or sizes. The upper perimeter 336 of the lower garment portion 308 in a front side 302 of the garment 300 may also be configured to recede downwards with a parabolic shape adjacent to and below the lower perimeter 334 of the upper garment portion 306 to make way for bellies of different sizes and shapes. The parabolic shape may include a shallow curvature, or, alternatively, a more pronounced curvature. Still further, the shape of the perimeters 334, 336 may have no curvature, or an inverted curvature. The upper garment portion 306 may comprise at least one shaper stitch region 314. As shown by example in FIGS. 8 and 9, the shaper stitch region 314 may extend circumferentially around all or portions of the upper garment portion 306.

The garments of this disclosure may be manufactured from materials made using any suitable textile manufacturing technique including knitting or weaving, for example, jersey knitting, rib stitching, interlock knitting and the like, as well as combinations thereof. Suitable materials may include (without limitation) nylon, polyester or spandex material and the like. Suitably, a garment may optionally contain greater than 5% spandex, greater than 10% spandex, and even greater than 15% spandex. A garment may also optionally contain less than 40% spandex, such as less than 30% spandex, and even less than 25% spandex. The garments may also be comprised of material having greater than 30 denier, greater than 40 denier, and even greater than 60 denier.

A suitable method of manufacturing a support garment according to this disclosure may include forming a garment material (from one or more pieces of fabric) or seamlessly knitting a shaper stitch region to a portion of the garment material so as to provide an elevated modulus of elasticity in at least one direction. Knitting may be used to apply a shaper stitch region circumferentially around the garment or to non-circumferential portions of the garments.

Methods of constructing the garments are not limited. For example, a suitable upper garment portion with shaper stitch region may be produced by knitting a 2×1 rib stitch tube with threads containing at least some spandex and knitting tubular jersey stitch hems. Alternatively, a suitable upper garment portion with shaper stitch region may be produced by knitting a 2×1 rib stitch tube, placing 1×1 rib stitches on the upper garment portion with threads containing at least some spandex and knitting a tubular jersey stitch hem.

While it is described above that garments of this disclosure can be worn during early stages of pregnancy and postpartum, it should be understood that garments of this disclosure can be worn at any time and by a wide range of users; for example, garments of this disclosure may be suitably worn during pregnancy or by those who are not pregnant, and of any age, shape, size and/or gender, including both women and men, without departing from this disclosure.

Although the garments and methods have been described in connection with specific forms thereof, it will be appreciated that a wide variety of equivalents may be substituted for the specified elements described herein without departing from the spirit and scope of this disclosure as described in the appended claims.

What is claimed is:

1. A garment, comprising:

(a) an upper garment portion configured to encircle a wearer's torso, the upper garment portion having an uppermost edge portion configured to reside in proximity to a wearer's inframammary line when the garment is worn;

(b) a lower garment portion seamlessly connected to the upper garment portion and comprising two leg portions, each leg portion configured to encircle at least a portion of one of the wearer's legs; and (c) at least one shaper stitch region included in at least a portion of the upper garment portion that extends downwards towards a frontal crotch region of the garment to provide a pelvis covering portion configured to cover a wearer's entire pelvic area, wherein the shaper stitch region is configured to apply a compressive force to the wearer's abdomen when the garment is worn.

2. The garment of claim 1, wherein a width of the pelvis covering portion of the shaper stitch region narrows as it extends downwards and approaches the frontal crotch region of the garment.

3. The garment of claim 1, wherein the shaper stitch region is included on a rear side of the garment and extends downward from the uppermost edge portion to a region at or above an upper perimeter of a wearer's buttocks when the garment is worn.

4. The garment of claim 1, wherein the shaper stitch region applies a uniform compressive force to a wearer's abdomen when the garment is worn.

5. The garment of claim 1, wherein the shaper stitch region comprises a material having a uniform modulus of elasticity.

6. The garment of claim 1, wherein the garment comprises at least one of a jersey knitted and interlock knitted material.

7. The garment of claim 1, wherein the garment comprises at least one of a nylon, spandex and polyester material.

8. The garment of claim 1, wherein the upper garment portion is formed to be seamless.

9. The garment of claim 1, further comprising a gusset in a crotch area of the garment.

10. The garment of claim 9, wherein the gusset is formed from a material having a modulus of elasticity higher in a first direction than in a second direction.

11. The garment of claim 1, wherein the leg portions are generally tubular.

12. The garment of claim 1, wherein the leg portions lack tubular leg-covering portions.

13. The garment of claim 1, wherein at least one of the uppermost edge portion and lowermost edges of the leg portions comprise a tubular hem stitch.

14. The garment of claim 1, wherein the garment comprises a single layer of material between hems at the uppermost edge portion and lowermost edges of the leg portions.

15. The garment of claim 1, wherein the shaper stitch region comprises at least one of rib stitching or jersey knitting.

16. A garment, comprising:

(a) a seamless upper garment portion configured to encircle a wearer's torso, the upper garment portion having an uppermost edge portion configured to reside in proximity to a wearer's inframammary line when the garment is worn, wherein a lower perimeter of the upper garment portion recedes downward in a parabolic curve such that the upper garment portion is configured to completely cover a wearer's belly area;

(b) a lower garment portion comprising at least one leg portion and connected to a lower edge of the upper garment portion, wherein an upper perimeter of the lower garment portion recedes downward in a parabolic curve; and (c) at least one shaper stitch region included in the upper garment portion, wherein the shaper stitch region is configured to apply a compressive force to the wearer's abdomen when the garment is worn by the wearer.

17. The garment of claim 16, wherein the shaper stitch region extends circumferentially around the upper garment portion.

18. The garment of claim 16, wherein the shaper stitch region continuously extends over the upper garment portion.

19. The garment of claim 16, wherein the shaper stitch region is non-circumferential and extends over a portion of a front side of the upper garment portion.

20. The garment of claim 16, wherein the garment comprises at least one of a jersey knitted and interlock knitted material.

21. The garment of claim 16, wherein the garment comprises at least one of a nylon, spandex, and polyester material.

22. The garment of claim 16, wherein the shaper stitch region on a rear side of the garment extends downward from the uppermost edge portion to a region at or above an upper perimeter of a wearer's buttocks when the garment is worn.

23. The garment of claim 16, wherein the shaper stitch region applies a uniform compressive force to a wearer's abdomen when the garment is worn.

24. The garment of claim 16, wherein the shaper stitch region comprises a material having a uniform modulus of elasticity.

25. The garment of claim 16, wherein the uppermost edge portion and lowermost edges of the leg portions comprise a tubular hem stitch.

26. The garment of claim 16, wherein the garment comprises a single layer of fabric between hems at the uppermost edge portion and lowermost edges of the leg portions.

27. The garment of claim 16, wherein the leg portion is tubular and configured to encircle at least a portion of both of the wearer's legs.

28. The garment of claim 16, wherein the lower garment portion comprises at least one of pants, jeans, trousers, leggings, sweat pants, yoga pants, underwear, swimwear or a skirt.

29. A method of manufacturing a support garment comprising:

(a) knitting a garment material, and (b) seamlessly applying a shaper stitch region to a portion of the garment material by knitting the material to exhibit an elevated modulus of elasticity, wherein the shaper stitch region extends downwards towards a frontal crotch region of the support garment to provide a pelvis covering portion configured to cover an entire pelvic area of a wearer.

30. The method of claim 29, wherein the shaper stitch region is applied circumferentially around the garment.

31. The method of claim 29, wherein the shaper stitch region is applied to non-circumferential portions of the garments.

32. The garment of claim 1 wherein the at least one shaper stitch region extends to the frontal crotch region and includes the pelvis covering portion.

33. The garment of claim 32 wherein the compressive force is applied to the pelvis covering portion and the frontal crotch region.

* * * * *